US008970612B2

(12) United States Patent
Chu et al.

(10) Patent No.: US 8,970,612 B2
(45) Date of Patent: Mar. 3, 2015

(54) IMAGE PROCESSING DEVICE, IMAGE PROCESSING METHOD, AND LIQUID CRYSTAL DISPLAY INCORPORATED WITH IMAGE PROCESSING DEVICE

(71) Applicant: Shenzhen China Star Optoelectronics Technology Co., Ltd., Shenzhen, Guangdong (CN)

(72) Inventors: Li-Wei Chu, Shenzhen (CH); Chih-Hao Wu, Shenzhen (CN); Jhen-Wei He, Shenzhen (CN); Yu-Yeh Chen, Shenzhen (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 139 days.

(21) Appl. No.: 13/878,225

(22) PCT Filed: Jan. 31, 2013

(86) PCT No.: PCT/CN2013/071226

§ 371 (c)(1),
(2) Date: Apr. 7, 2013

(87) PCT Pub. No.: WO2014/114011

PCT Pub. Date: Jul. 31, 2014

(65) Prior Publication Data

US 2014/0210837 A1 Jul. 31, 2014

(30) Foreign Application Priority Data

Jan. 28, 2013 (CN) ..... 2013 1 0031579

(51) Int. Cl.

| | |
|---|---|
| ***G09G 5/36*** | (2006.01) |
| ***G09G 5/39*** | (2006.01) |
| ***G09G 5/02*** | (2006.01) |

(52) U.S. Cl.
CPC ..... *G09G 5/02* (2013.01)
USPC ..... 345/545; 345/531

(58) Field of Classification Search
CPC .. G06T 1/60; G06F 13/00; G09G 5/36–5/366
USPC ..... 345/530, 536, 531, 545, 557
See application file for complete search history.

(56) References Cited

U.S. PATENT DOCUMENTS

| | | | | |
|---|---|---|---|---|
| 6,313,822 | B1 * | 11/2001 | McKay et al. | 345/698 |
| 2012/0275718 | A1 * | 11/2012 | Takamori et al. | 382/238 |

*Primary Examiner* — Jacinta M Crawford
(74) *Attorney, Agent, or Firm* — Andrew C. Cheng

(57) ABSTRACT

The present invention provides an image processing device, including a buffering unit, a minifying unit, a synchronous dynamic random access memory (SDRAM), an overdriving unit, a comparing unit, a restoring unit, and an output controlling unit. The present invention further provides an image processing method and a liquid crystal display incorporated with the image processing device. The image processing device, the image processing method, and the liquid crystal display incorporated with the image processing device will not only directly perform the overdrive-processing of an input high-resolution image, but will also, on the one hand caches an input high-resolution image by the buffering unit, and on the other hand minifies an input high-resolution image. As a result, the image data is already reduced when the overdrive-processing performs, and the consumption of the space of the SDRAM is also accordingly reduced. For the input of a high-resolution image, there is no need to increase the amount of the SDRAM anymore, and it is easier to control the overall cost. During output, a static image is directly output, and a dynamic image is output through the overdrive-processing and the restoration of original resolution to maintain the quality of the image.

13 Claims, 3 Drawing Sheets

IMAGE PROCESSING DEVICE, IMAGE PROCESSING METHOD, AND LIQUID CRYSTAL DISPLAY INCORPORATED WITH IMAGE PROCESSING DEVICE

The present patent application claims priority from Chinese Patent Application, No. 201310031579.3, entitled "Image Processing Device, Image Processing Method, and Liquid Crystal Display Incorporated with Image Processing Device", and filed on Jan. 28, 2013 in the China Patent Office, the entire contents of which are hereby incorporated herein by reference.

FIELD OF THE INVENTION

The present invention relates to a technical field of an image display, and more particularly to an image processing device, an image processing method, and a liquid crystal display incorporated with the image processing device.

BACKGROUND OF THE INVENTION

A thin film transistor liquid crystal display (TFT-LCD) is widely used in the field of image display for its advantages of high resolution, slim, compact, and low energy consumption, etc. However, because the TFT-LCD utilizes a maintenance driving pattern to control the passage and shutter of the light by the twist of liquid crystal molecules, this needs a reacting time, thereby resulting a longer response time of the TFT-LCD. As a result, when the TFT-LCD displays some images, especially a dynamic image, there exists a blurred edge or a blurred image. In light of this, how to improve the response time is the focus of the technology research for every firm.

An overdrive (OD) technology is an important technical method for improving the response time of the TFT-LCD, and it uses the relationship between the twisting speed of liquid crystal molecules and the driving voltage. The higher the driving voltage, the faster the twisting speed of the liquid crystal molecules is, and the faster the response time is. As shown in FIG. 1, when the prior art method is operated, input images are simultaneously delivered to an overdriving unit and a frame buffering device, and the overdriving unit determines the grey level of final output images via look-up tables based on the input images and images from the frame buffering device. At this time, the original resolution is maintained by images stored in the frame buffering device.

As the high resolution gradually becomes a current important developing aspect and trend of flat panel displays, the increase of the resolution will also greatly increase the amount of data needed to be processed, and the requirement of the frame buffering device will also greatly increase during a process of overdriving. Currently, the frame buffering device is usually equipped with a synchronous dynamic random access memory (SDRAM), and the price of the SDRAM is proportional to its capacity. As a result, if the resolution of input images increases, the required capacity of the SDRAM will also be increased, and thereby the amount of the SDRAM must accordingly be increased to match the expansion of the capacity. This will cause a significant increase of the manufacturing cost of TFT-LCD, and it disadvantages the cost control.

SUMMARY OF THE INVENTION

It is an object of the present invention to provide an image processing device, an image processing method, and a liquid crystal display incorporated with the image processing device, which can readily resolve the prior art problems and effectively reduces the usage of the SDRAM thereby reducing the manufacturing cost.

In order to resolve the technical issue encountered by the prior art, the present invention provides an image processing device, including the following elements. A buffering unit is included to cache a first image of high resolution input therein. A minifying unit is provided to create a second image by reducing proportionally the resolution of the first image. The image processing device further includes a synchronous dynamic random access memory (SDRAM) to receive and temporarily store the second image, and then outputting a third image, which is the previous image of the second image. An overdriving unit is included to output a fourth image based on the overdrive-processing of the second and third images. A comparing unit is provided to determine similarity and difference between the second and third images, and output a result of the comparison. A restoring unit is provided to generate a fifth image by restoring the resolution of the fourth image to the same resolution of the first image when there is a difference between the second and third images determined by the comparing unit. The image processing device further includes an output controlling unit to output the fifth image when a difference between the second and third images is determined by the comparing unit, or output the first image when the second and third images are determined as being identical by the comparing unit.

Wherein the high-resolution image is an image with its resolution higher than a full high definition image.

Wherein the image processing device further comprises a compressing processing unit for compressing the second image which is stored in the SDRAM, and decompressing the third image output by the SDRAM.

Wherein the image processing device further comprises an input controlling unit for determining the resolution of input images, wherein when the resolution of the input images is higher than the full high definition image, the input images are delivered to the buffering unit and the minifying unit respectively; and wherein when the resolution of the input images is lower than the full high definition image, the input images are delivered to the SDRAM and the overdriving unit directly.

The present invention further provides a liquid crystal display incorporated with an image processing device, comprises a buffering unit for caching a first image of high resolution input therein; a minifying unit for creating a second image by reducing proportionally the resolution of the first image; a synchronous dynamic random access memory (SDRAM) for receiving and temporarily storing the second image, and outputting a third image, which is the previous image of the second image; an overdriving unit for outputting a fourth image based on the overdrive-processing of the second and third images; a comparing unit for determining similarity and difference between the second and third images, and outputting a result of the comparison; a restoring unit for generating a fifth image by restoring the resolution of the fourth image to the same resolution of the first image when there is a difference between the second and third images determined by the comparing unit; and an output controlling unit for outputting the fifth image when a difference between the second and third images is determined by the comparing unit, or outputting the first image when the second and third images are determined as being identical by the comparing unit.

Wherein the high-resolution image is an image with its resolution higher than a full high definition image.

Wherein further comprises a compressing processing unit for compressing the second image which is stored in the SDRAM, and decompressing the third image output by the SDRAM.

Wherein further comprises an input controlling unit for determining the resolution of input images, wherein when the resolution of the input images is higher than the full high definition image, the input images are delivered to the buffering unit and the minifying unit respectively; and wherein when the resolution of the input images is lower than the full high definition image, the input images are delivered to the SDRAM and the overdriving unit directly.

The present invention further provides an image processing method, including the steps of a) caching a high-resolution image input therein as a first image; b) generating a second image by reducing the resolution of the high resolution image input therein; c) receiving and temporarily storing the second image, and outputting a third image, which is the previous image of the second image; d) outputting a fourth image based on the overdrive-processing of the second and third images; e) comparing and determining whether there is a difference between the second and third images or not, and outputting a result after comparing; f) outputting the first image when the second and third images are identical; g) generating a fifth image by restoring the resolution of the fourth image identical to the resolution of the first image when the second and third images are different; and h) outputting the fifth image.

Wherein the high-resolution image is an image with its resolution higher than a full high definition image.

Wherein further comprising a step of compressing the second image before receiving and temporarily storing the second image; and further including a step of decompressing the third image before performing overdrive-processing of the second and third images.

Wherein further comprises a step of input controlling for determining the resolution of input images and controlling a control to the input images according to a result of the determination.

Wherein the step of input controlling further comprises a step of caching input images and reducing the resolution of input high-resolution images when the resolution of the input image is higher than the full high definition image; and delivering input images to the overdriving unit for the overdrive-processing when the resolution of the input images is lower than the full high definition images.

The image processing device, the image processing method, and the liquid crystal display incorporated with the image processing device will not only directly perform the overdrive-processing of an input high-resolution image, but will also, on the one hand caches an input high-resolution image by the buffering unit, and on the other hand minifies an input high-resolution image. In light of this, the image data is already reduced when the overdrive-processing performs, and the consumption of the space of the SDRAM is also accordingly reduced. For the input of a high-resolution image, there is no need to increase the amount of the SDRAM anymore, and it is easier to control the overall cost. During output, a static image is directly output, and a dynamic image is output through the overdrive-processing and the restoration of original resolution to maintain the quality of the image.

BRIEF DESCRIPTION OF DRAWINGS

In order to give a better and thorough understanding to the whole and other intended purposes, features and advantages of the present invention or the technical solution of the prior art, detailed description will be given with respect to preferred embodiments provided and illustrated here below in accompanied drawings. Apparently, with the spirit of the embodiments disclosed, persons in the skilled in the art can readily come out with other modifications as well as improvements without undue experiment. In addition, other drawings can be readily achieved based on the disclosed drawings.

DETAILED DESCRIPTION OF PREFERRED EMBODIMENTS

Detailed description will be given with respect to preferred embodiments provided and illustrated here below in accompanied drawings.

The idea in accordance with the embodiment of the present invention is that input high-resolution images are not directly stored in a SDRAM, but caching directly the unprocessed and original high-resolution images in a buffering device. In addition, the image data of the original high-resolution images is reduced by a minifying device, and then the minified images are delivered to an overdriving unit for a normal overdrive-processing. Finally, a comparing device compares and determines whether there is a difference between the current and previous images or not. If they are identical, images are categorized as static images and will be temporarily stored as the original high-resolution images in the buffering device; and vice versa, when dynamic images are determined, and they will be restored to the original resolution after overdrive-processing, and then be output. As a result, when the SDRAM is used to perform the overdrive-processing, the size and the resolution of images stored in the SDRAM are already reduced, and it is therefore no need to expand the capacity of the SDRAM for adapting the original high-resolution images. In turn, it is beneficial as this arrangement saves a considerable amount of the SDRAM as well as controllable cost, while the quality of images also has not been compromised. In the embodiment of the present invention, the high-resolution image is an image with its resolution higher than a full high definition image (FHD, which is usually 1920×1080), for example, an ultra high definition image (UHD, which is usually 3840×2160).

Figure 1:
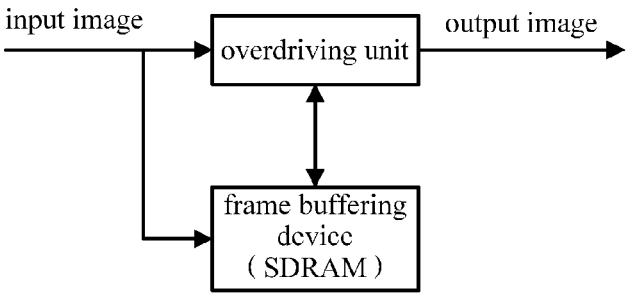
FIG. 1 is an illustration view of a prior art overdrive-processing.
Figure 2:
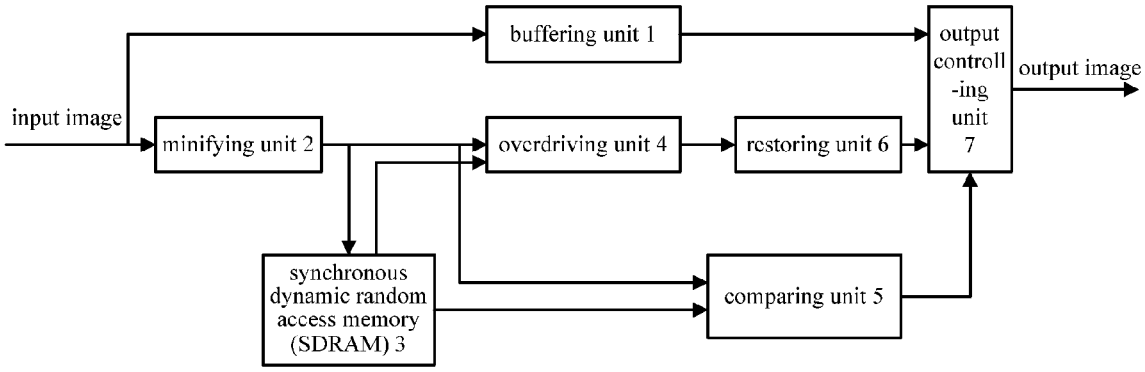
FIG. 2 is a structural and illustration view of a first embodiment of an image processing device made in accordance with the present invention.

Referring to FIG. 2, an image processing device made in accordance with the first embodiment of the present invention includes the following elements. A buffering unit 1 is included to cache a first image of high resolution input therein. A minifying unit 2 is provided to create a second image by reducing proportionally the resolution of the first image. The image processing device further includes a synchronous dynamic random access memory (SDRAM) 3 to receive and temporarily store the second image, and then outputting a third image, which is the previous image of the second image. An overdriving unit 4 is included to output a fourth image based on the overdrive-processing of the second and third images. A comparing unit 5 is provided to determine similarity and difference between the second and third images, and output a result of the comparison. A restoring unit 6 is provided to generate a fifth image by restoring the resolution of the fourth image to the same resolution of the first image when there is a difference between the second and third images determined by the comparing unit 5. The image processing device further includes an output controlling unit 7 to output the fifth image when a difference between the second and third images is determined by the comparing unit 5, or output the first image when the second and third images are determined as being identical by the comparing unit 5.

Taking input of an ultra high definition image (4 k×2 k) for example, the ultra high definition image (i.e. the first image) will be simultaneously delivered to the buffering unit 1 and the minifying unit 2, respectively, and the second image is generated by reducing the resolution to full high definition (1920×1080) by the minifying unit 2. The data of the second image is much smaller than the first image, so the consumption of the capacity of the SDRAM is accordingly much lesser than the first image directly stored without minifying process, and it is therefore beneficially achieve the result of reducing manufacturing cost. Because of caching of the SDRAM 3, the previous image (i.e. the third image) of the second image is output after storing the second image. The overdriving unit 4 compares the variation of the data of the second and third images, and performs a normal overdrive-processing via the look-up table (LUT), and generates the fourth image. The comparing unit 5 then determines similarity and difference between the second and third images, and outputs a result of the comparison, which includes identical or unidentical. If the second and third images are identical, which means that there is no difference between the previous and following images and is concluded as the static image, and the first image will be output from the buffering unit 1 by the output controlling unit 7. There is no need and necessity for the static image to be processed by the overdrive-processing, and the output quality of the image maintains the same as the original image. If the second and third images are determined as not being identical, which means that there is a difference between the previous and following images and is concluded as the dynamic image, and the overdriving processed image will be output. Because the resolution of the overdriving processed fourth image is reduced by the minifying unit 2, the restoring unit 6 generates a fifth image by restoring the resolution of the fourth image to the same resolution of the first image, and then the output controlling unit 7 conducts the outputting. Because the resolution of the fifth image is already restored to the same resolution of the original input image (i.e. the first image) before being output, the quality of the image would not be compromised.

From the foregoing description of the embodiment of the present invention, the image processing device will not only directly perform the overdrive-processing of an input high-resolution image, but will also, on the one hand caches an input high-resolution image by the buffering unit, and on the other hand minifies an input high-resolution image. In light of this, the image data is already reduced when the overdrive-processing performs, and the consumption of the space of the SDRAM is also accordingly reduced. For the input of a high-resolution image, there is no need to increase the amount of the SDRAM anymore, and it is easier to control the overall cost. During output, a static image is directly output, and a dynamic image is output through the overdrive-processing and the restoration of original resolution to maintain the quality of the image. It should be understood that there is still some loss of the data of images, even after the minifying unit 2 performs a minifying process and the restoring unit 6 performs a restoring process. Nevertheless, the loss is too trivial to be noticeable at most times, and therefore can be neglected. As a result, the data, which needs to be processed by the overdrive-processing, is reduced by the image processing device in accordance with the embodiment of the present invention, and the quality of images would not be compromised, so the image processing device is very practical and worth implementation.

Figure 3:
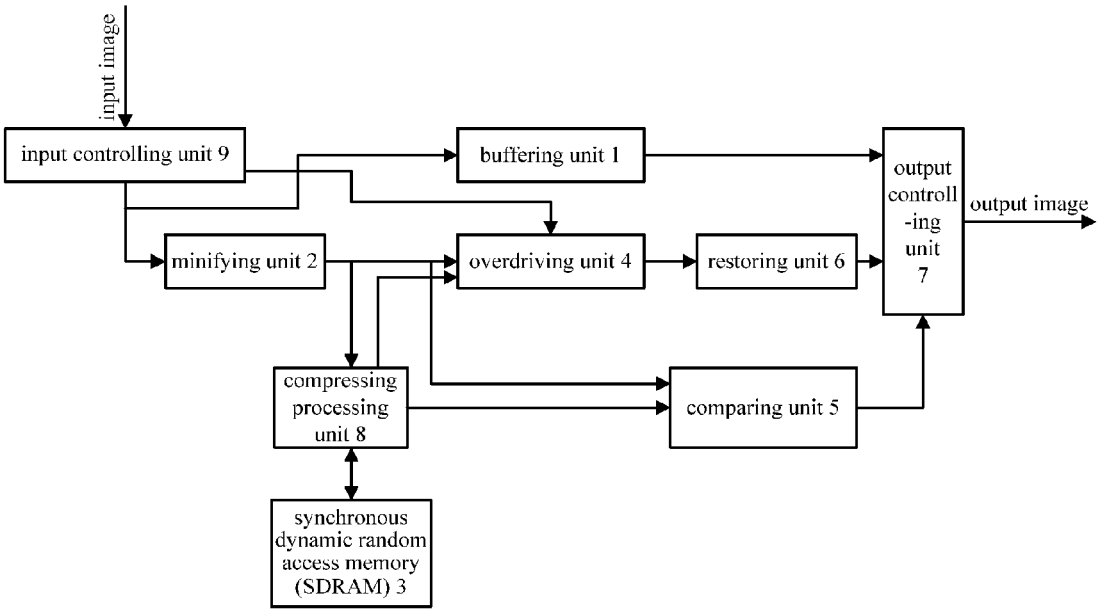
FIG. 3 is another one structural and illustration view of a first embodiment of an image processing device made in accordance with the present invention.

Referring to FIG. 3, the image processing device of the first embodiment of the present invention further includes the following element. A compressing processing unit 8 is included to compress the second image which is stored in the SDRAM 3, and decompress the third image output by the SDRAM 3. In light of this, when images are stored in the SDRAM 3, the data would be further reduced because of previous compression, and the consumption of the capacity of the SDRAM is much less, so the usage of the SDRAM is further reduced; and the same will be decompressed after it is retrieved, and this will provide a base for readily processing thereafter.

In addition, the image processing device of the embodiment of the present invention further comprises an input controlling unit 9 located in front of the input of images, for determining the resolution of input images, wherein when the resolution of the input images is higher than the full high definition image, the input images are delivered to the buffering unit 1 and the minifying unit 2 respectively, such as shown in FIG. 2; and wherein when the resolution of the input images is lower than the full high definition image, the input images are delivered to the SDRAM 3 and the overdriving unit 4 directly. The image processing device in accordance with the embodiment of the present invention is designed to process the high-resolution images. If the resolution of input images is not such high and the amount of the data is not huge, while the usage of the SDRAM will be less as well, and then it is not necessary that the minifying unit 2 performs a minifying process and the buffering unit 1 performs a caching process, but performing an overdrive-processing directly by the conventional method instead. As a result, the establishment of the input controlling unit 9 for determining the resolution of input images in advance is beneficial to provide flexible choices of following processes.

A liquid crystal display implementing the image processing device disclosed FIGS. 2 and 3 is also provided in accordance with a second embodiment of the present invention.

Figure 4:
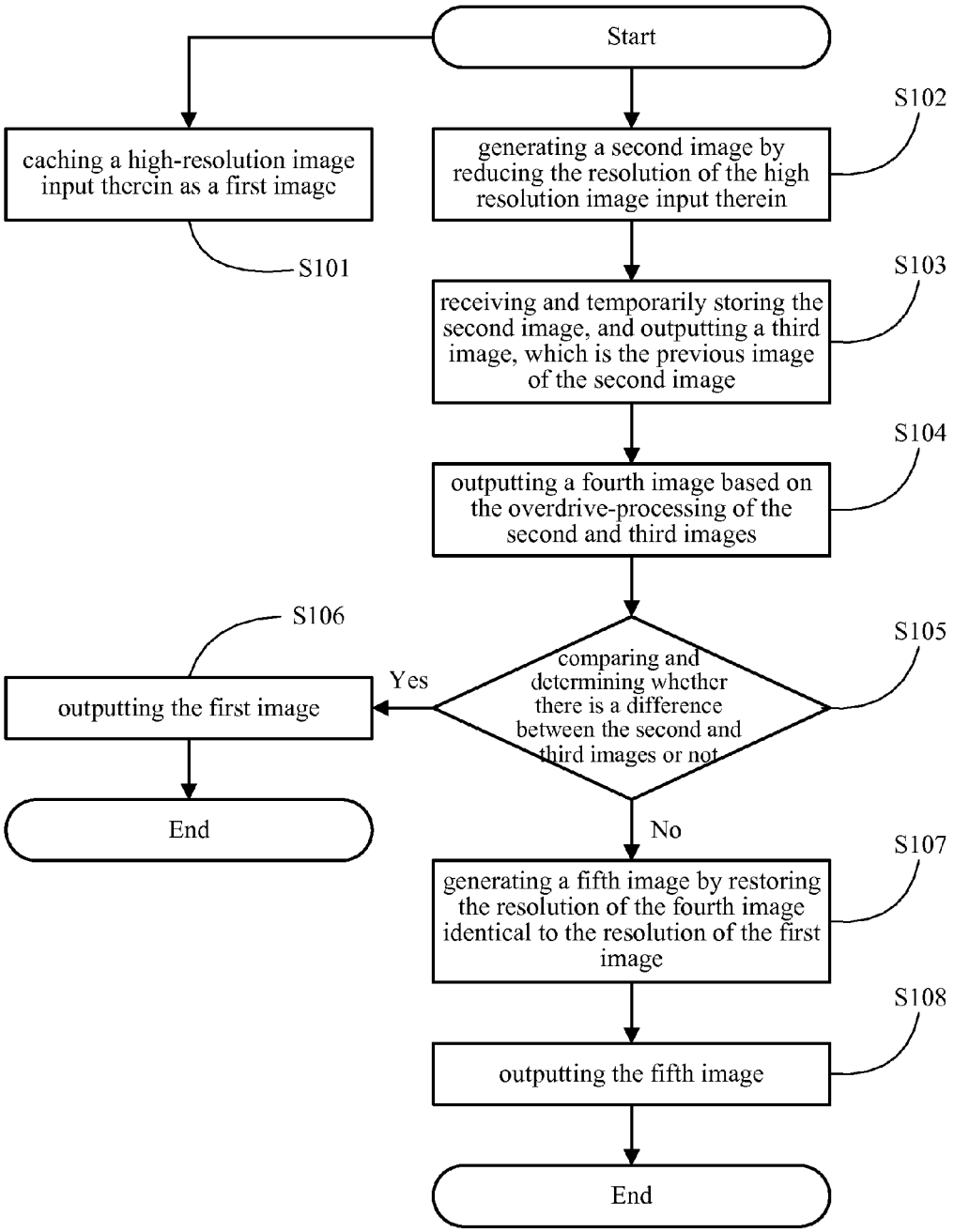
FIG. 4 is a flow-chart diagram illustrating the steps of a third embodiment of an image processing method made in accordance with the present invention.

Please refer to FIG. 4, in referring to the image processing device of the first embodiment, the third embodiment of the present invention provides an image processing method, including the followings steps.

Step S101, caching a high-resolution image input therein as a first image.

Step S102, generating a second image by reducing the resolution of the high resolution image input therein; and performing simultaneously with the Step S101.

Step S103, receiving and temporarily storing the second image, and outputting a third image, which is the previous image of the second image.

Step S104, outputting a fourth image based on the overdrive-processing of the second and third images.

Step S105, comparing and determining whether there is a difference between the second and third images or not, and outputting a result after comparing.

Step S106, outputting the first image when the second and third images are identical.

Step S107, generating a fifth image by restoring the resolution of the fourth image identical to the resolution of the first image when the second and third images are different.

Step S108, outputting the fifth image.

Similar to the first embodiment in accordance with the present invention, the image processing method will not only directly perform the overdrive-processing of an input high-resolution image, but will also, on the one hand caches an input high-resolution image by the buffering unit, and on the other hand minifies an input high-resolution image. In light of this, the image data is already reduced when the overdrive-processing performs, and the consumption of the space of the SDRAM is also accordingly reduced. For the input of a high-resolution image, there is no need to increase the amount of the SDRAM anymore, and it is easier to control the overall cost. During output, a static image is directly output, and a dynamic image is output through the overdrive-processing and the restoration of original resolution to maintain the quality of the image.

As a further improvement, a step of compressing the second image before the Step S103, receiving and temporarily storing the second image; and further including a step of decompressing the third image before the Step S104, performing overdrive-processing of the second and third images. As a result, when images are stored in the SDRAM 3, the data would be further reduced because of previous compression, and the consumption of the capacity of the SDRAM is much less, so the usage of the SDRAM is further reduced; and the same will be decompressed after it is retrieved, and this will provide a base for readily processing thereafter.

In addition, before the Step S101 and S102, it further comprises a step of input controlling for determining the resolution of input images and controlling a control to the input images according to a result of the determination. Substantially, the Step S101 and S102 would be carried out when the resolution of the input image is higher than the full high definition image; and delivering input images to the overdriving unit for the overdrive-processing when the resolution of the input images is lower than the full high definition images. The image processing method in accordance with the embodiment of the present invention is designed to process the high-resolution images. If the resolution of input images is not such high and the amount of the data is not huge, while the usage of the SDRAM will be less as well, and then it is not necessary of a minifying process, but performing an overdrive-processing directly by the conventional method instead. In light of this, the establishment of the input controlling unit 9 for determining the resolution of input images in advance is beneficial to provide flexible choices of following processes.

Preferred embodiments of the present invention have been described, but not intending to impose any unduly constraint to the appended claims. Any modification of equivalent structure or equivalent process made according to the disclosure and drawings of the present invention is considered encompassed in the scope of protection defined by the claims of the present invention.

The invention claimed is:

1. An image processing device, including a buffering unit for caching a first image of high resolution input therein;

a minifying unit for creating a second image by reducing proportionally the resolution of the first image;

a synchronous dynamic random access memory (SDRAM) for receiving and temporarily storing the second image, and outputting a third image which is an image temporarily stored in the synchronous dynamic random access memory previous to the second image;

an overdriving unit for outputting a fourth image based on an overdrive-processing of the second and third images;

a comparing unit for determining similarity and difference between the second and third images, and outputting a result of the comparison;

a restoring unit for generating a fifth image by restoring the resolution of the fourth image to the same resolution of the first image when there is a difference between the second and third images determined by the comparing unit; and an output controlling unit for outputting the fifth image when a difference between the second and third images is determined by the comparing unit, or outputting the first image when the second and third images are determined as being identical by the comparing unit.

2. The image processing device as recited in claim 1, wherein the high-resolution image is an image with its resolution higher than a full high definition image.

3. The image processing device as recited in claim 1, further comprising a compressing processing unit for compressing the second image which is stored in the SDRAM, and decompressing the third image output by the SDRAM.

4. The image processing device as recited in claim 1, further comprising an input controlling unit for determining the resolution of input images, wherein when the resolution of the input images is higher than the full high definition image, the input images are delivered to the buffering unit and the minifying unit respectively; and wherein when the resolution of the input images is lower than the full high definition image, the input images are delivered to the SDRAM and the overdriving unit directly.

5. A liquid crystal display incorporated with an image processing device, comprising a buffering unit for caching a first image of high resolution input therein;

a minifying unit for creating a second image by reducing proportionally the resolution of the first image;

a synchronous dynamic random access memory (SDRAM) for receiving and temporarily storing the second image, and outputting a third image which is an image temporarily stored in the synchronous dynamic random access memory previous to the second image;

an overdriving unit for outputting a fourth image based on an overdrive-processing of the second and third images;

a comparing unit for determining similarity and difference between the second and third images, and outputting a result of the comparison;

a restoring unit for generating a fifth image by restoring the resolution of the fourth image to the same resolution of the first image when there is a difference between the second and third images determined by the comparing unit; and an output controlling unit for outputting the fifth image when a difference between the second and third images is determined by the comparing unit, or outputting the first image when the second and third images are determined as being identical by the comparing unit.

6. The liquid crystal display incorporated with the image processing device as recited in claim 5, wherein the high-resolution image is an image with its resolution higher than a full high definition image.

7. The liquid crystal display incorporated with the image processing device as recited in claim 5, further comprising a compressing processing unit for compressing the second image which is stored in the SDRAM, and decompressing the third image output by the SDRAM.

8. The liquid crystal display incorporated with the image processing device as recited in claim 5, further comprising an input controlling unit for determining the resolution of input images, wherein when the resolution of the input images is higher than the full high definition image, the input images are delivered to the buffering unit and the minifying unit respectively; and wherein when the resolution of the input images is lower than the full high definition image, the input images are delivered to the SDRAM and the overdriving unit directly.

9. An image processing method, including the steps of:

a) caching a high-resolution image input therein as a first image;

b) generating a second image by reducing the resolution of the high resolution image input therein;

c) receiving and temporarily storing the second image, and outputting a third image which is an image temporarily stored previous to the second image;

d) outputting a fourth image based on than overdrive-processing of the second and third images;

e) comparing and determining whether there is a difference between the second and third images or not, and outputting a result after comparing;

f) outputting the first image when the second and third images are identical;

g) generating a fifth image by restoring the resolution of the fourth image identical to the resolution of the first image when the second and third images are different; and h) outputting the fifth image.

10. The method as recited in claim 9, wherein the high-resolution image is an image with its resolution higher than a full high definition image.

11. The method as recited in claim 9, further comprising a step of compressing the second image before receiving and temporarily storing the second image; and further including a step of decompressing the third image before performing overdrive-processing of the second and third images.

12. The method as recited in claim 9, further comprising a step of input controlling for determining the resolution of input images and controlling a control to the input images according to a result of the determination.

13. The method as recited in claim 12, wherein the step of input controlling further comprises a step of caching input images and reducing the resolution of input high-resolution images when the resolution of the input image is higher than the full high definition image; and delivering input images to the overdriving unit for the overdrive-processing when the resolution of the input images is lower than the full high definition images.

* * * * *